US010232661B2

(12) United States Patent
Wu

(10) Patent No.: US 10,232,661 B2
(45) Date of Patent: Mar. 19, 2019

(54) ENCLOSURE APPARATUS FOR DISPENSING CONTAINER

(71) Applicant: Changi Wu, Edison, NJ (US)

(72) Inventor: Changi Wu, Edison, NJ (US)

( * ) Notice: Subject to any disclaimer, the term of this patent is extended or adjusted under 35 U.S.C. 154(b) by 701 days.

(21) Appl. No.: 14/877,905

(22) Filed: Oct. 7, 2015

(65) Prior Publication Data

US 2017/0101233 A1 Apr. 13, 2017

(51) Int. Cl.

| | |
|---|---|
| ***A45D 40/00*** | (2006.01) |
| ***B43K 1/00*** | (2006.01) |
| ***A45D 40/22*** | (2006.01) |
| ***B43K 31/00*** | (2006.01) |
| ***A45D 40/02*** | (2006.01) |

(52) U.S. Cl.

CPC ..... *B43K 1/006* (2013.01); *A45D 40/00* (2013.01); *A45D 40/023* (2013.01); *A45D 40/222* (2013.01); *B43K 31/00* (2013.01); *A45D 2040/0012* (2013.01); *A45D 2040/225* (2013.01); *A45D 2040/228* (2013.01)

(58) Field of Classification Search

CPC ..... B43K 1/006; B43K 31/00; A45D 40/023; A45D 40/00; A45D 40/222; A45D 2040/228; A45D 2040/225; A45D 2040/0012; B65D 47/0866; B65D 39/02; B65D 39/025; B65D 39/12

USPC ..... 206/457

See application file for complete search history.

(56) References Cited

U.S. PATENT DOCUMENTS

| | | | | | |
|---|---|---|---|---|---|
| 122,688 | A * | 1/1872 | Ward | B65D 47/0866 | 222/517 |
| 971,055 | A * | 9/1910 | Locandho | B65D 47/2018 | 222/491 |
| 1,589,107 | A * | 6/1926 | Campbell, Jr. | B65D 47/0866 | 222/517 |
| 1,832,056 | A * | 11/1931 | Spencer | A47G 29/06 | 109/33 |
| 1,979,828 | A * | 11/1934 | Fullmer | A45D 40/023 | 401/102 |
| 2,002,716 | A * | 5/1935 | Richter | A45D 40/023 | 401/59 |
| 2,019,681 | A * | 11/1935 | Kasdan | A45D 40/023 | 401/59 |
| 2,055,414 | A * | 9/1936 | Lehmann | A45D 40/023 | 132/318 |
| 2,089,832 | A * | 8/1937 | Kasdan | A45D 40/065 | 401/59 |

(Continued)

*Primary Examiner* — Ernesto A Grano

(74) *Attorney, Agent, or Firm* — Changi Wu Law Office

(57) ABSTRACT

An enclosure apparatus is adopted to a dispensing container having a dispensing side such as but not limited to maker or a candy container. The enclosure apparatus comprises a cap, a lid, and a tubular sleeve having a first end and a second end. The lid is attached to the cap by a hinge and rotatable around the hinge to be in open position or close position. The tubular sleeve is coaxially disposed inside the cap, wherein the cap is relatively slidable along the tubular sleeve. The enclosure apparatus encloses the dispensing side of the dispensing container inside the cap when the cap slides toward the first end of the tubular sleeve and causes the lid in the close position, wherein the dispensing side extends outside the cap when the cap slides toward the second end of the tubular sleeve and causes the lid in the open position.

12 Claims, 7 Drawing Sheets

(56) References Cited

U.S. PATENT DOCUMENTS 2,091,312 A * 8/1937 Fullmer ..... A45D 40/023 15/184
2,404,815 A * 7/1946 Satz ..... A45D 40/023 15/184
2,443,361 A * 6/1948 Satz ..... A45D 40/065 401/59
2,463,086 A * 3/1949 Chabbert ..... A45D 40/065 401/59
2,610,732 A * 9/1952 Calhoun ..... A45D 40/023 206/385
4,896,139 A * 1/1990 Eldridge ..... E05B 65/0888 200/61.71
5,002,182 A * 3/1991 McGinnis ..... A45C 11/34 144/28.1
5,170,904 A * 12/1992 Neuhaus ..... B65F 1/08 220/262
5,171,096 A * 12/1992 Perrotti ..... A45D 40/065 401/59
5,423,622 A * 6/1995 Perrotti ..... A45D 40/065 401/108
5,531,318 A * 7/1996 Coleman ..... A45D 40/023 206/385
5,898,371 A * 4/1999 Marek ..... A47G 29/1225 200/61.63
5,979,468 A * 11/1999 Blake, III ..... A45D 40/06 132/317
6,200,049 B1 * 3/2001 Pinhel ..... A45D 40/06 401/63
6,231,254 B1 * 5/2001 Holloway ..... A45D 40/04 132/318
6,402,407 B1 * 6/2002 Goldstein ..... B43K 23/016 401/6
6,671,920 B2 * 1/2004 Pearlman ..... A45D 40/023 132/308
D534,212 S * 12/2006 Chan ..... B43K 5/005 D19/157
D539,846 S * 4/2007 Hutchings ..... D19/180
7,232,270 B1 * 6/2007 Goldstein ..... B43K 23/004 401/92
7,331,730 B2 * 2/2008 Fukui ..... B43K 5/17 401/108
7,500,799 B2 * 3/2009 Holloway ..... A45D 40/06 401/174
7,629,757 B2 * 12/2009 Murphy ..... A45D 40/18 318/266
7,681,501 B1 * 3/2010 Wishert ..... F42B 4/20 102/342
8,152,398 B2 * 4/2012 Kim ..... A45D 40/065 401/108
8,215,857 B2 * 7/2012 Carroll ..... A45D 40/02 401/107
D667,214 S * 9/2012 Manga ..... D3/206
D671,167 S * 11/2012 Nichols ..... D19/102
8,493,369 B2 * 7/2013 Liang ..... B43K 23/06 178/19.01
8,524,300 B1 * 9/2013 Diamond ..... A23G 3/563 206/385
8,622,642 B2 * 1/2014 Kim ..... A45D 40/065 401/107
D701,902 S * 4/2014 Nichols ..... D19/85
8,727,650 B2 * 5/2014 Carroll ..... A45D 34/04 401/107
9,642,439 B2 * 5/2017 Holloway ..... A45D 40/04
9,814,294 B2 * 11/2017 Hermouet ..... A45D 40/065
D807,960 S * 1/2018 Lo ..... D19/204
2002/0032069 A1 * 3/2002 Arrison ..... B43K 23/016 473/36
2004/0007594 A1 * 1/2004 Esch ..... B65D 51/28 222/145.1
2008/0075520 A1 * 3/2008 Grossman ..... B43K 23/016 401/89
2009/0245919 A1 * 10/2009 Rennecker ..... A45D 34/041 401/108
2009/0245922 A1 * 10/2009 Armstrong ..... A45D 40/023 401/172
2010/0028071 A1 * 2/2010 Kurek ..... A45D 40/02 401/107
2011/0123249 A1 * 5/2011 Delbove ..... A45D 40/023 401/59
2011/0250004 A1 * 10/2011 Chung ..... B43K 21/16 401/94
2013/0025296 A1 * 1/2013 Leavitt ..... B65D 81/3484 62/4
2013/0058701 A1 * 3/2013 Chan ..... A45D 40/22 401/59
2014/0174464 A1 * 6/2014 Drugeon ..... A45D 33/30 132/200
2014/0219703 A1 * 8/2014 Kim ..... A45D 40/026 401/59
2014/0299049 A1 * 10/2014 Constantino, Jr. ..... A47J 43/22 118/19
2014/0374300 A1 * 12/2014 Espinosa ..... B65F 1/163 206/457
2015/0119866 A1 * 4/2015 Nichiporenko ..... A61B 90/39 606/1
2016/0374456 A1 * 12/2016 Oh ..... A45D 40/02 401/82
2017/0042310 A1 * 2/2017 Heraud ..... A45D 40/023
2017/0217245 A1 * 8/2017 Damman ..... B43K 23/016
2017/0347773 A1 * 12/2017 Seidler ..... A61M 35/003
2018/0000052 A1 * 1/2018 Donegan ..... A01K 39/012

* cited by examiner

ENCLOSURE APPARATUS FOR DISPENSING CONTAINER

CROSS-REFERENCE RELATED TO RELATED APPLICATIONS

Not Applicable.

BACKGROUND

Dispensing containers that have a side to dispense contents can be a writing instrument, such as a marker or a highlighter, lipstick, or candy can. For example, a mark has a dispensing side with felt tip to dispense the mark liquid out of the marker. Normally, a cap is used to enclose the dispensing side to prevent the dryness of the dispensing side or incident dispense of the contents. The cap generally is detachable from the container when the container is used to dispense the contents. When the cap is detached from the container, the cap is easily misplaced, lost, or dropped, which results in the dispensing side continuing to dispense the contents or causes the dryness of the dispensing side.

SUMMARY

The current invention is an enclosure apparatus to be adopted to a dispensing container having a barrel and an dispensing side to dispense contents in the container. The enclosure apparatus comprises a cap having a top, a bottom, and a wall, wherein the wall is between the top and bottom, wherein a hole is formed through the top of the cap and continuously through the bottom of the cap, and the hole is surrounded by the wall, and wherein the wall has art inside surface and an outside surface; a lid having an outside surface and an inside surface opposed to the outside surface, wherein the lid further comprising a hinge to connect with the top of the cap, wherein the lid is rotatable at the hinge to form a close position and an open position, wherein the lid substantially cover the hole on the top of the cap when it is in the close position, wherein the lid reveals the hole of the cap when the lid is in the open position; and a tubular sleeve having a first end, a second end, and a shell, wherein the shell of the tubular sleeve is between the first end and the second end, wherein the first end of the tubular sleeve is coaxially disposed inside the cap, wherein the cap is relatively slidable along the tubular sleeve between the first end and the second end of the tubular sleeve, wherein the second end of the tubular sleeve can be coupled to the barrel of the dispensing container, wherein the enclosure apparatus encloses the dispensing side of the container inside the cap when the cap slides toward the first end of the tubular sleeve and causes the lid in the close position, wherein the dispensing side extends outside the cap when the cap slides toward the second end of the tubular sleeve and causes the lid in the open position, and wherein the shell of the tubular sleeve has an inner surface and an outer surface.

DETAILED DESCRIPTION

Figure 1:
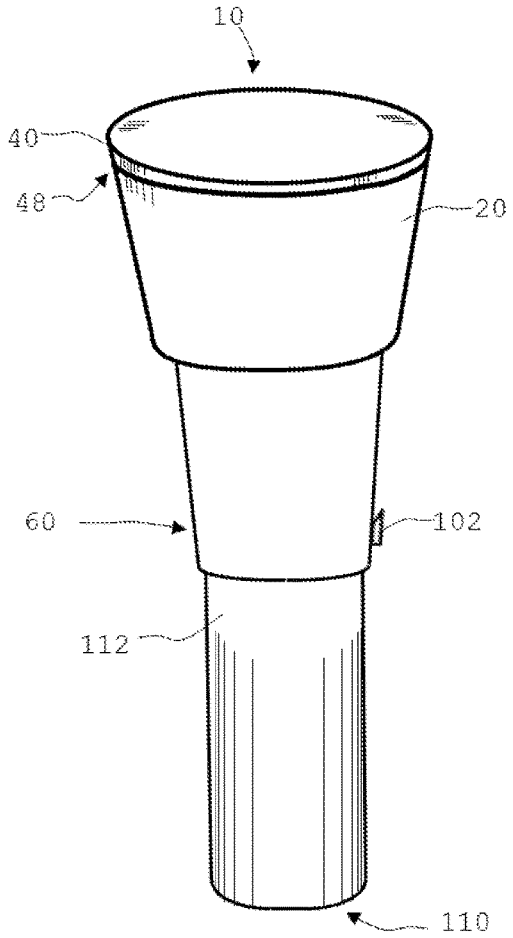
FIG. 1 is a perspective view of an enclosure apparatus adopted to a dispensing container according to the present invention.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" include plural referents unless the context clearly dictates otherwise. Thus, for example, reference to "a plate" includes a plurality of such plates and reference to "the peripheral portion" includes reference to one or more peripheral portions, and so forth.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Referring to FIG. 1, one of the embodiments of an enclosure apparatus 10 is adopted to a dispensing container 110, such as marker, highlighter, lipstick, and candy can. The enclosure apparatus 10 has a cap 20, a lid 40, a tubular sleeve 60. The tubular sleeve 60 is secured on the barrel 112 of the dispensing container 110. Also referring to FIG. 1, one of the embodiments of an enclosure apparatus 10 shows that lid 40 can be in a close position 48. A embodiment of a stopper 102 having a height between zero and two centimeters is attached on the tubular sleeve 60.

Figure 2:
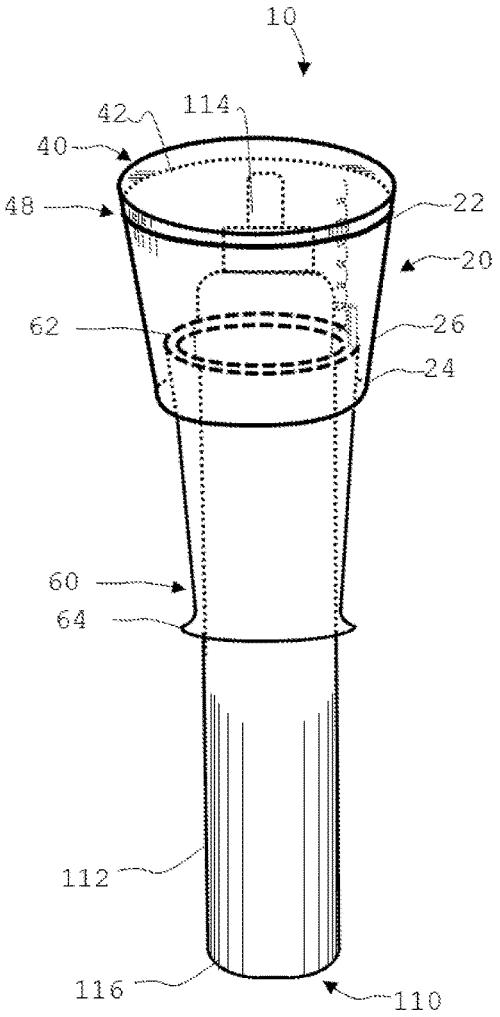
FIG. 2 is a perspective view of an enclosure apparatus adopted to a dispensing container according to the present invention.

Referring to FIG. 2, one of the embodiments of an enclosure apparatus 10 showing the dispensing side 114 of a dispensing container 110 is enclosed in the enclosure apparatus 10 when the cap 20 is near the first end 62 of the tubular sleeve 60 and the lid 40 is in a close position 48. Also referring to FIG. 2 is one of the embodiments of an enclosure apparatus 10 showing that lid 40 has an outside surface 42 and the cap 20 has a top 22, bottom 24, and a wall 26 extending between the top 22 and the bottom 24. Also referring to FIG. 2 is the tubular sleeve 60 has the second end 64 that is larger than the bottom 24 of the cap 20 so that bottom 24 will not slide beyond the second end 64 of the tubular sleeve 60 when the cap 20 slides down toward the second end 64 of the tubular sleeve 60. Also referring to FIG. 2, one of the embodiment of the dispensing container 110, such as a writing instrument, has a barrel 112 extends longitudinally between the dispensing side 114 and the bottom end 116 of the dispensing container 110, where the dispensing container 110 can be a writing instrument such as a marker or highlighter and the dispensing side 140 can be a writing end of a writing instrument, such as the felt tip of marker or highlighter.

Figure 3:
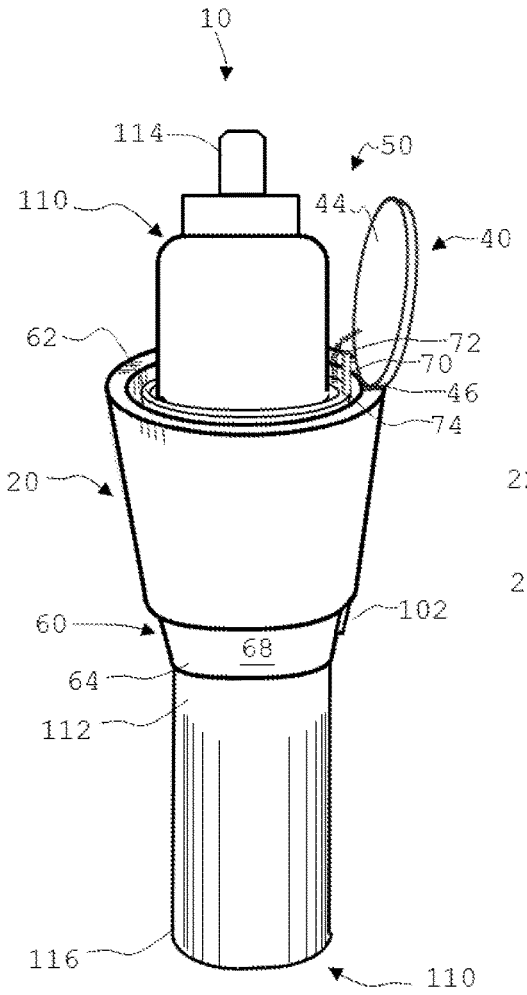
FIG. 3 is another perspective view of an enclosure apparatus adopted to a dispensing container according to the present invention.

Referring to FIG. 3, one of the embodiments of an enclosure apparatus 10 shows that the lid 40 is in an open position 50. Also referring to FIG. 3, 3, one of the embodiments of an enclosure apparatus 10 shows that stub 70, having an upper end 72 and a bottom end 74 wherein bottom end 74 is attached on the first end 62 of the tubular sleeve 60. The lid 40 is hinged to the cap 20 by a hinge 46. When the cap 20 is moved toward the second end 64 of the tubular sleeve 60, the upper end 72 of the stub 70 will touch the inside surface 44 of the lid 40, and push the lid 40 into an open position 50. Also referring to FIG. 3, 3, one of the embodiments of an enclosure apparatus 10 shows that when the lid 40 is in the open position 50, the dispensing side 114 of the dispensing container 110 is revealed. Also referring to FIG. 3 is one of the embodiments of the stopper 102 having a height between zero and two centimeters secured on the outer surface 63 of the tubular sleeve 60 and is to prevent the cap 20 from moving beyond the second end 64 of the tubular sleeve 60. Also referring to FIG. 3, one of the embodiments of the dispensing container 110 has a dispensing side 114, a bottom 116, and a barrel 112 extending between dispensing side 114 and bottom 116.

Figure 4:
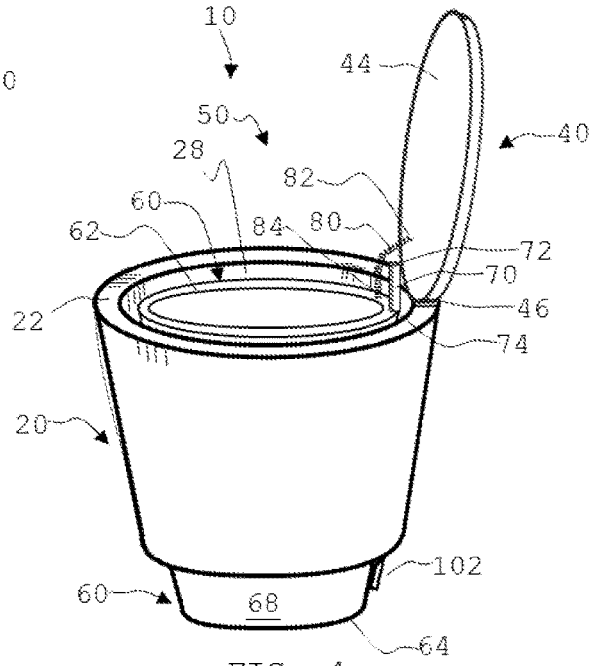
FIG. 4 is another perspective view of an enclosure apparatus according to the present invention.

Referring to FIG. 4, one of the embodiments of enclosure apparatus 10 has a lid 40 that is attached to the top 22 of the cap 20 by a hinge 46 allowing the lid 40 to rotate around the hinge 46. Also referring to FIG. 4 is one of the embodiments of an enclosure apparatus 10 showing the lid 40 attached to the hinge 46 is in an open position 50 that reveals the hole 28 formed in the cap 20. Also referring to FIG. 4, one of the embodiments of the enclosure apparatus 10 shows that a stopper 102 is attached on the outer surface 68 of the tubular sleeve 60 near the second end 64 of the tubular sleeve 60. Also referring to FIG. 4, one of the embodiments of the enclosure apparatus 10 shows that a stub 70 having an upper end 72 and a bottom end 74 is attached to the first end 62 of the tubular sleeve 60. Also referring to FIG. 4, one of the embodiments of enclosure apparatus 10 has an resilience spring 80 having a first end 82 and a second end 84 where the first end 82 is attached to the inside surface 44 of the lid 40 and the second end 84 is attached to the first end 62 of the tubular sleeve 60. The resilience spring 80 can be made of iron, rubber, plastic, or other elastic materials.

Figure 5:
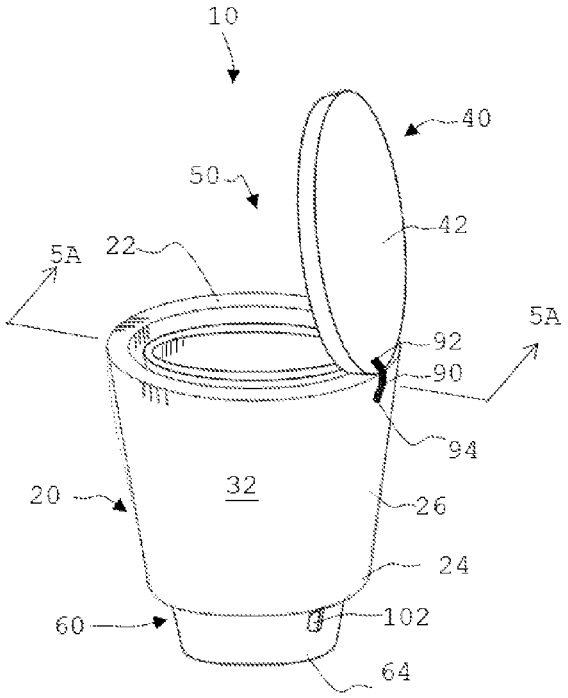
FIG. 5 is another perspective view of an enclosure apparatus according to the present invention.

Referring to FIG. 5, one of the embodiments of the enclosure apparatus 10 shows the lid 40 having an outside surface 42 is in an open position 50, the cap 20 having an outside surface 32, on where, near the top 22 of the cap 20, an elastic spring 90 having a first end 92 attached to the outside surface 42 of the lid 40 and a second end 94 attached to the outside surface 32 of the wall 26 near the top 22 of the cap 20. The elastic spring 90 presses against the lid 40 when the lid 40 is in open position 50. Also referring to FIG. 5 is one of the embodiments of the enclosure apparatus 10 shows the bottom 24 of the cap 20 is disposed on the stopper 102 that is attached to the tubular sleeve 60 near the second end 64 of the tubular sleeve 60.

Figure 5A:
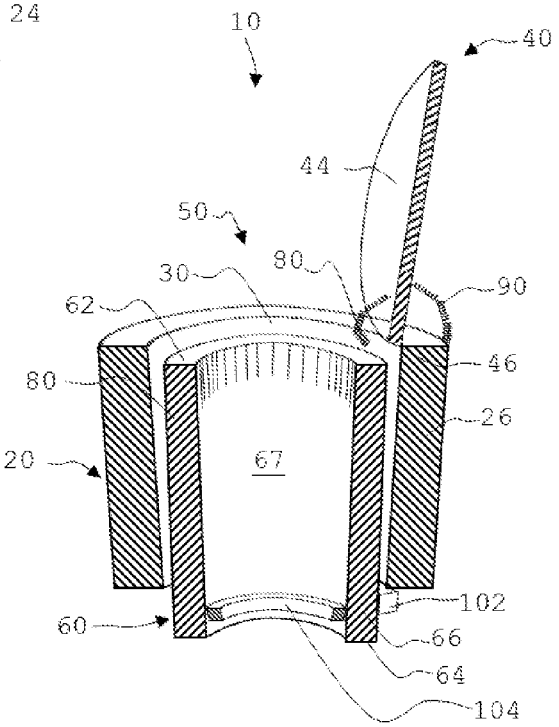
FIG. 5A is a section view of an enclosure apparatus according to the present invention.

Referring to FIG. 5A, a section view of one of the embodiments of the enclosure apparatus 10 showing a fastener 104 is attached on the inner surface 67 of the shell 66 of the tubular sleeve 60 near the second end 64 of the tubular sleeve 60. The fastener 104 can be made of rubber or plastic that is flexible and has traction allowing the fastener 104 to mount the enclosure apparatus 10 to the surface of an object, such as writing instrument. Also referring to 5A, a section view of one of the embodiments of an enclosure apparatus 10 has the first end 62 of the tubular sleeve 60 coaxially is disposed inside the cap 20 in where the cap 20 is relatively slidable along the tubular sleeve 60 between the first end 62 and the second end 64 of the tubular sleeve 60. Also referring to FIG. 5A is one of the embodiments of the enclosure apparatus 10 showing the resilience spring 80 is attached on the inside surface 30 of the wall 26 and the inside surface 44 of lid 4 and also showing that the elastic spring 90 is one the opposite side of the lid 40. Referring to FIG. 5A is one of the embodiments of the enclosure apparatus 10 that has a stopper 102 near the second end 64 of the tubular sleeve 60. The resilience spring 80 can be made of elastic material like rubber or plastic that can stretch or resile. Referring to FIG. 5A, the lid 40 is connected on the top 22 of the cap 20 by a hinge 46 that can be a crease or pivotal hinge.

Figure 6:
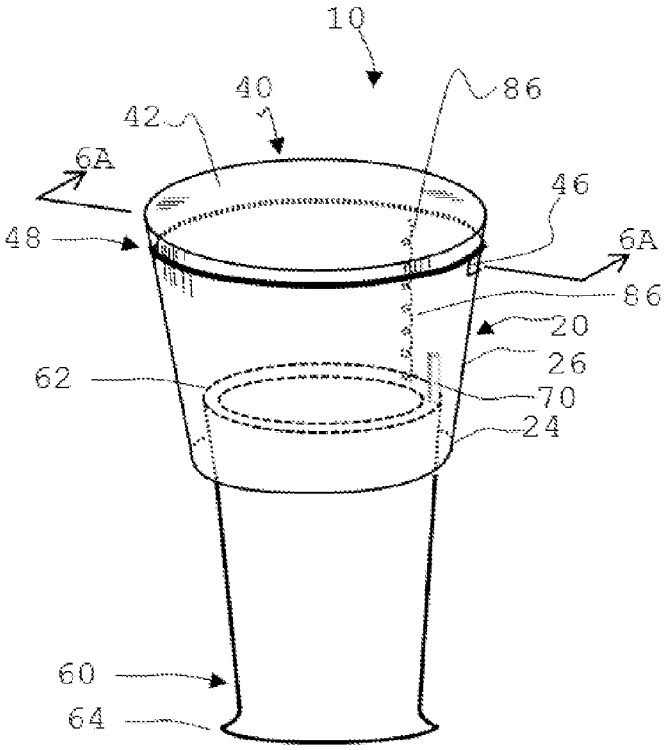
FIG. 6 is another perspective view of an enclosure apparatus according to the present invention.

Referring to FIG. 6, one of the embodiments of an enclosure apparatus 10 shows that the lid 40 has an outside surface 42 is in a close position 48 that covers the cap 20. Also referring to FIG. 6, one of the embodiments of the enclosure apparatus 10 showing the cap 20 which has a wall 26 and a bottom 24, and the tubular sleeve 60 and an enlarged second end 64 to prevent the bottom 24 of the cap 20 will not fall out of the second end 64 of the tubular sleeve 60. Also referring to FIG. 6, one of the embodiments of the enclosure apparatus 10 shows the resilience string 86 and the stub 70 inside the cap 20. A section view of FIG. 6 is shown on FIG. 6A.

Figure 6A:
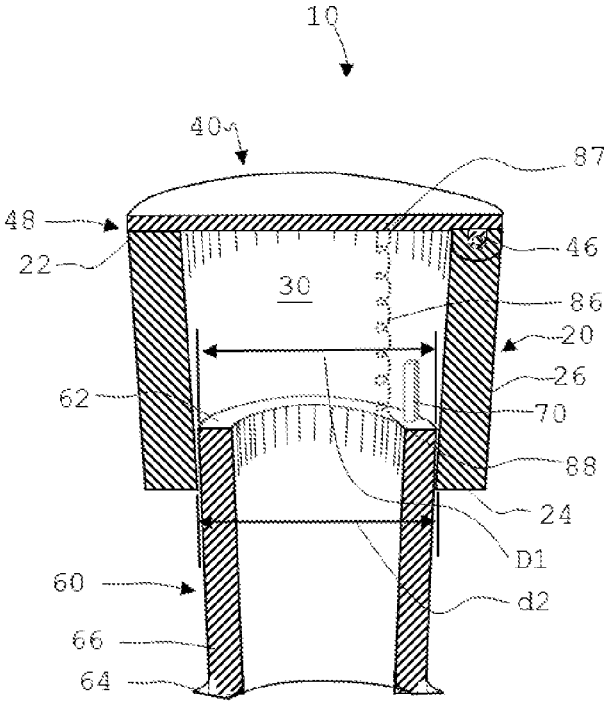
FIG. 6A is a section view of an enclosure apparatus according to the present invention.

Referring to FIG. 6A, one of the embodiments of enclosure apparatus 10 shows the lid 40 is attached to a hinge 46 that connects to the top 22 of the cap 20 and allows the lid 40 to rotate around the hinge 46 to reach close position 48 or to become open. Also referring to FIG. 6A, one of the embodiments of the enclosure apparatus 10 shows the first end 62 of the tubular sleeve 60 has an outer diameter D1 greater than the inner diameter d2 of the bottom 24 of the cap 20 so that the first end 62 of tubular sleeve 60 will not slide beyond the bottom 24 of the cap 20. Also referring to FIG. 6A, one of the embodiments of the enclosure apparatus 10 shows the first end 62 of the tubular sleeve 60 is larger than the bottom 24 of the cap 20 so that the first end 62 of tubular sleeve 60 will not slide beyond the bottom 24 of the cap 20. Also referring to FIG. 6A, one of the embodiments of the enclosure apparatus 10 shows that the resilience string 86 has a first end 87 attached to lid 40 and a second end 88 attached to first end 62 of the tubular sleeve 60.

Figure 7:
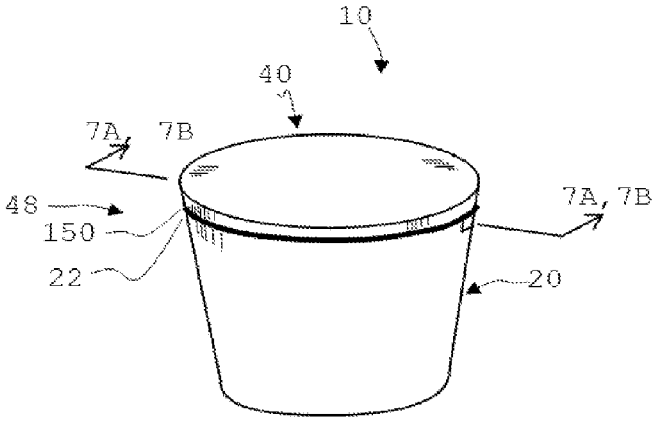
FIG. 7 is another perspective view of an enclosure apparatus according to the present invention.

Referring to FIG. 7, one of the embodiments of an enclosure apparatus 10 showing that the lid 40 in a close position 48 is secured by a lock 150 attached on the lid 40 and the top 22 of the cap 20. A section view of FIG. 7 is shown on FIG. 7A. Another section view of FIG. 7 is shown on FIG. 7A.

Figure 7A:
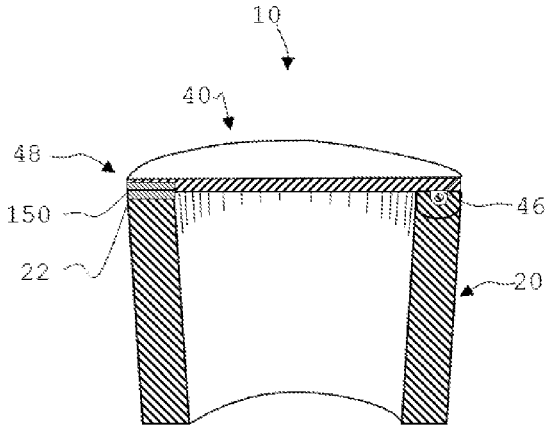
FIG. 7A is a section view of an enclosure apparatus according to the present invention.

Referring to FIG. 7A, one of the embodiments of an enclosure apparatus 10 showing a section view that lock 150 can comprise at least two pieces of magnetic material that attract each other so that the lid 40 can be secured to the top 22 of the cap 20 when in a close position 48. FIG. 7A shows only one of the embodiments of lock 150, and lock 150 can be constructed by any apparatus commercially available or known to a person of ordinary skill of the art for securing a lid 40 to cap 20.

Figure 7B:
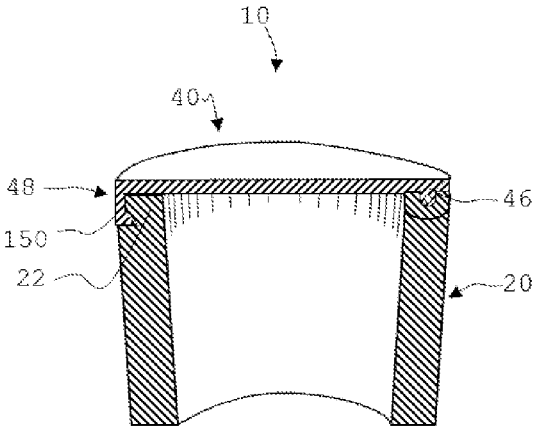
FIG. 7B is a section view of an enclosure apparatus according to the present invention.

Referring to FIG. 7B, one of the embodiments of an enclosure apparatus 10 showing a section view that lock 150 can comprise clips that can be secure the lid 40 to the top 22 of the cap 20 when in a close position 48. FIG. 7B shows only one of the embodiments of lock 150, and lock 150 can be constructed by any apparatus commercially available or known to a person of ordinary skill of the art for securing a lid 40 to cap 20.

Figure 8:
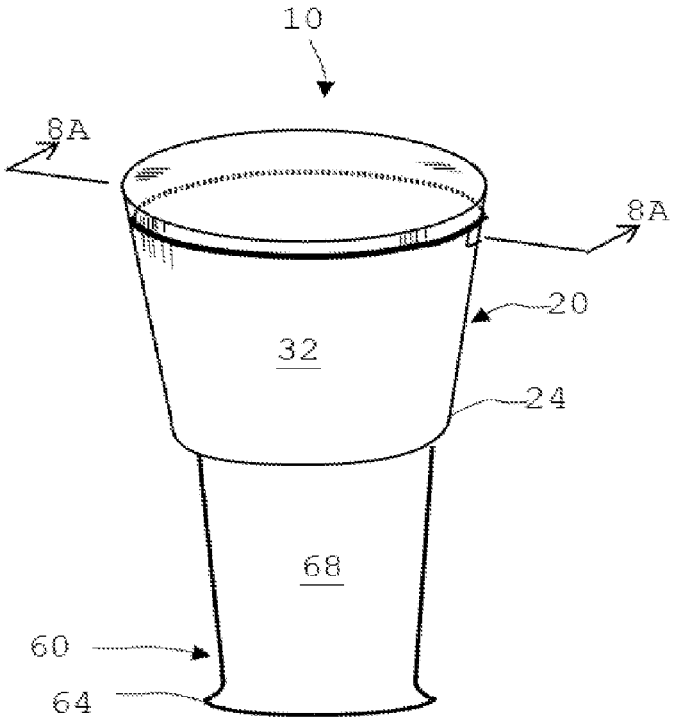
FIG. 8 is another perspective view of an enclosure apparatus according to the present invention.
Figure 8A:
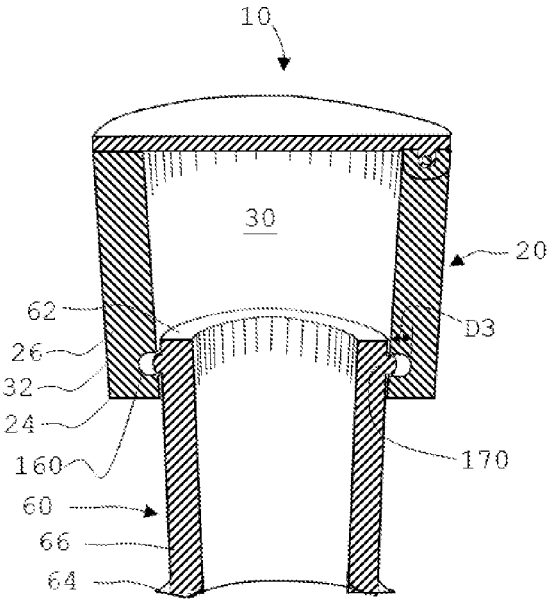
FIG. 8A is a section view of an enclosure apparatus according to the present invention.

Referring to FIG. 8, one of the embodiments of an enclosure apparatus 10 showing that a cap 20 having an outside surface 32 and a bottom 24 resides on a tubular sleeve 60 having an outer surface 68 and a second end 64. A section view 8A is shown on FIG. 8A Referring to FIG. 8A, one of the embodiments of an enclosure apparatus 10 showing that a groove 160 is formed radially on the inside surface 30 of the wall 26 of the cap 20 approximately near the bottom 24 of the cap 20, and that the groove 160 is depressed into the wall 26 between the inside surface 30 and the outside surface 32 of the wall 26. Also referring to FIG. 8A, one of the embodiment of an enclosure apparatus 10 shows that a ring 170 is formed radically on the outer surface 68 of the tubular sleeve 60 near the first end 62 of the tubular sleeve 60 and that the ring 170 protrudes outward the outer surface 68 of the tubular sleeve 60 between zero centimeters and a depth D3 of the groove 160. Also referring to FIG. 8A, one of the embodiments of the enclosure apparatus 10 shows that the ring 170 is disposed in the groove 160 to secure the bottom 24 of the cap 20 to stay near the first end 62 of the tubular sleeve 60 when the cap 20 slides toward the first end 62 of the tubular sleeve 60, and the ring 170 cab be disengaged from the groove 160 when the cap 20 slides toward the second end 64 of the tubular sleeve 60.

Figure 9:
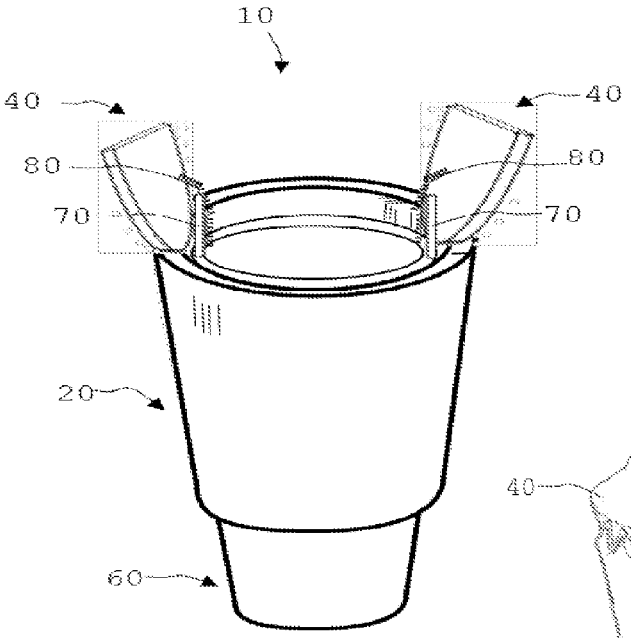
FIG. 9 is another perspective view of an enclosure apparatus according to the present invention.
Figure 10:
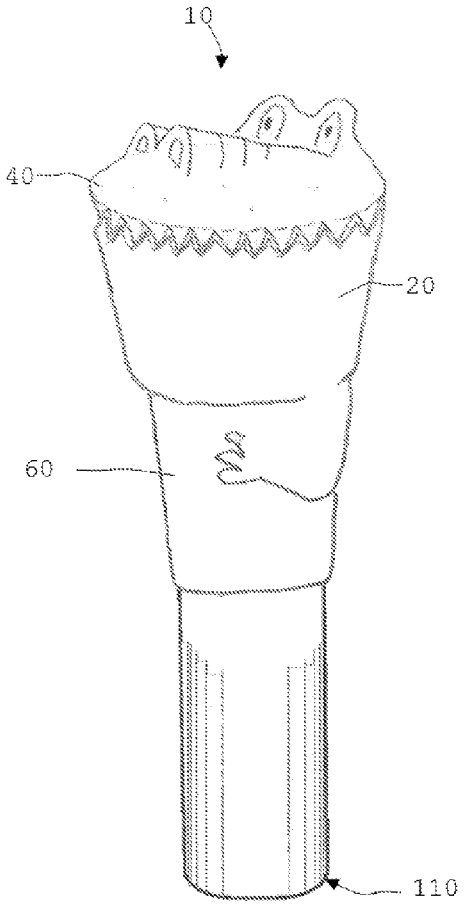
FIG. 10 is another perspective view of an enclosure apparatus adopted to a dispensing container according to the present invention.

Referring to FIG. 9, one of the embodiments of enclosure apparatus 10 shows that the enclosure apparatus 10 has tubular sleeve 60, cap 20, and two lids 40 attached to the cap 20, and two stubs 70 and two resilience springs 80 are used for each of the lid 40.

Referring FIG. 9, one of the embodiments of enclosure apparatus 10 can be in an animated figure such as a crocodile.

The invention claimed is:

1. An enclosure apparatus to be adopted to a dispensing container having a barrel and a dispensing side to dispense contents in the dispensing container, comprising:

a cap having a top, a bottom, and a wall, wherein the wall is between the top and the bottom, wherein a hole is formed through the top of the cap and continuously through the bottom of the cap, and the hole is surrounded by the wall, and wherein the wall has an inside surface and an outside surface;

a lid having an outside surface and an inside surface opposed to the outside surface, wherein the lid further comprising a hinge to connect with the top of the cap, wherein the lid is rotatable at the hinge to form a close position and an open position, wherein the lid substantially covers the hole on the top of the cap when it is in the close position, wherein the lid reveals the hole of the cap when the lid is in the open position;

a tubular sleeve having a first end, a second end, and a shell, wherein the shell of the tubular sleeve is between the first end and the second end, wherein the first end of the tubular sleeve is coaxially disposed inside the cap, wherein the cap is relatively slidable along the tubular sleeve between the first end and the second end of the tubular sleeve, wherein the second end of the tubular sleeve can be coupled to the barrel of the dispensing container, wherein the enclosure apparatus encloses the dispensing side of the dispensing container inside the cap when the cap slides toward the first end of the tubular sleeve and causes the lid in the close position, wherein the dispensing side extends outside the cap when the cap slides toward the second end of the tubular sleeve and causes the lid in the open position, and wherein the shell of the tubular sleeve has an inner surface and an outer surface; and a stub having an upper end and a bottom end, wherein the bottom end of the stub is attached on the first end of the tubular sleeve, wherein the upper end of the stub is extended between the first end of the tubular sleeve and the top of the cap, wherein the upper end of the stub touches the inside surface of the lid and pushes the lid outward to allow the lid in the open position when the cap slides down the tubular sleeve toward the second end of the tubular sleeve.

2. The enclosure apparatus as recited in claim 1, wherein the second end of the tubular sleeve is relatively larger than the bottom of the cap for preventing the bottom of the cap from sliding beyond the second end of the tubular sleeve when the cap slides down toward the second end of the tubular sleeve.

3. The enclosure apparatus as recited in claim 1, wherein the second end of the tubular sleeve has an outer diameter larger than an inner diameter of the bottom of the cap for preventing the bottom of the cap from sliding beyond the second end of the tubular sleeve when the cap slides down toward the second end of the tubular sleeve.

4. The enclosure apparatus as recited in claim 1, wherein the tubular sleeve further comprises a stopper attached on the outer surface of the tubular sleeve, wherein the stopper has a height between zero and two inches, wherein the stopper prevents the bottom of the cap from sliding beyond the second end of the tubular sleeve when the cap slides down toward the second end of the tubular sleeve.

5. The enclosure apparatus as recited in claim 1, wherein a groove is formed radially on the inside surface of the wall of the cap approximately near the bottom of the cap, wherein the groove is depressed into the wall between the inside surface and the outside surface of the wall, wherein the groove has a depth between the inside surface of the wall and the outside surface of the wall, wherein a ring is formed radically on the outer surface of the tubular sleeve near the first end of the tubular sleeve, wherein the ring protrudes outward the outer surface of the tubular sleeve between zero and the depth of the groove, wherein the ring is disposed in the groove to secure the bottom of the cap to stay near the first end of the tubular sleeve when the cap slides toward the first end of the tubular sleeve, and wherein the ring is disengaged from the groove when the cap slides toward the second end of the tubular sleeve.

6. The enclosure apparatus as recited in claim 1, further comprising a fastener attached to the second end of the tubular sleeve, wherein the fastener mounts the tubular sleeve of the enclosure apparatus to the barrel of the dispensing container.

7. The enclosure apparatus as recited in claim 1, further comprising an elastic spring having a first end and a second end, wherein the first end is connected of the elastic spring is connected with the outside surface of the lid, wherein the second end of the elastic spring is connected with the outside surface of the wall of the cap, and wherein the elastic spring pushes the lid toward the close position of the lid.

8. The enclosure apparatus as recited in claim 1, further comprising a lock attached to the lid and the top of the cap for securing the lid to the top of the cap when the lid is in the close position.

9. The enclosure apparatus as recited in claim 1, wherein the enclosure apparatus can be in an animated figure.

10. The enclosure apparatus as recited in claim 1, wherein the dispensing container further comprises a writing instrument having writing end and a bottom end, wherein the barrel extends longitudinally between the writing end and the bottom end.

11. An enclosure apparatus to be adopted to a dispensing container having a barrel and a dispensing side to dispense contents in the dispensing container, comprising:

a cap having a top, a bottom, and a wall, wherein the wall is between the top and the bottom, wherein a hole is formed through the top of the cap and continuously through the bottom of the cap, and the hole is surrounded by the wall, and wherein the wall has an inside surface and an outside surface;

a lid having an outside surface and an inside surface opposed to the outside surface, wherein the lid further comprising a hinge to connect with the top of the cap, wherein the lid is rotatable at the hinge to form a close position and an open position, wherein the lid substantially covers the hole on the top of the cap when it is in the close position, wherein the lid reveals the hole of the cap when the lid is in the open position;

a tubular sleeve having a first end, a second end, and a shell, wherein the shell of the tubular sleeve is between the first end and the second end, wherein the first end of the tubular sleeve is coaxially disposed inside the cap, wherein the cap is relatively slidable along the tubular sleeve between the first end and the second end of the tubular sleeve, wherein the second end of the tubular sleeve can be coupled to the barrel of the dispensing container, wherein the enclosure apparatus encloses the dispensing side of the dispensing container inside the cap when the cap slides toward the first end of the tubular sleeve and causes the lid in the close position, wherein the dispensing side extends outside the cap when the cap slides toward the second end of the tubular sleeve and causes the lid in the open position, and wherein the shell of the tubular sleeve has an inner surface and an outer surface; and a resilience spring having a first end and a second end, wherein the first end of the resilience spring is connected to the inside surface of the lid and the second end of the resilience spring is connected to one selected from the top of the cap, the inside surface of the wall of the cap, the inner surface of the shell of the tubular sleeve, and the first end of the tubular sleeve, and wherein the resilience spring pulls the lid toward the close position of the lid.

12. An enclosure apparatus to be adopted to a dispensing container having a barrel and a dispensing side to dispense contents in the dispensing container, comprising:

a cap having a top, a bottom, and a wall, wherein the wall is between the top and the bottom, wherein a hole is formed through the top of the cap and continuously through the bottom of the cap, and the hole is surrounded by the wall, and wherein the wall has an inside surface and an outside surface;

a lid having an outside surface and an inside surface opposed to the outside surface, wherein the lid further comprising a hinge to connect with the top of the cap, wherein the lid is rotatable at the hinge to form a close position and an open position, wherein the lid substantially covers the hole on the top of the cap when it is in the close position, wherein the lid reveals the hole of the cap when the lid is in the open position;

a tubular sleeve having a first end, a second end, and a shell, wherein the shell of the tubular sleeve is between the first end and the second end, wherein the first end of the tubular sleeve is coaxially disposed inside the cap, wherein the cap is relatively slidable along the tubular sleeve between the first end and the second end of the tubular sleeve, wherein the second end of the tubular sleeve can be coupled to the barrel of the dispensing container, wherein the enclosure apparatus encloses the dispensing side of the dispensing container inside the cap when the cap slides toward the first end of the tubular sleeve and causes the lid in the close position, wherein the dispensing side extends outside the cap when the cap slides toward the second end of the tubular sleeve and causes the lid in the open position, and wherein the shell of the tubular sleeve has an inner surface and an outer surface;

a resilience string having a first end and a second end, wherein the first end of the resilience string is connected to the inside surface of the lid and the second end of the resilience string is connected to one of selected from the top of the cap, the inside surface of the wall of the cap, the shell of the tubular sleeve, and the first end of the tubular sleeve, and wherein the resilience string pulls the lid toward the close position of the lid.

* * * * *